United States Patent [19]

Jelinek et al.

[11] 4,133,129

[45] Jan. 9, 1979

[54] RAPID LOADING DEVICE FOR REVOLVERS

[76] Inventors: Heinz Jelinek, Kaiserebersdorferstrasse 218, 1110 Vienna; Fritz Carmann, Helferstorferstrasse 3, 1010 Vienna, both of Austria

[21] Appl. No.: 826,706

[22] Filed: Aug. 22, 1977

[30] Foreign Application Priority Data

Aug. 23, 1976 [AT] Austria ..... 6225/76
Jun. 28, 1977 [AT] Austria ..... 4564/77

[51] Int. Cl.[2] ..... F42B 39/04
[52] U.S. Cl. ..... 42/89
[58] Field of Search ..... 42/89

[56] References Cited

U.S. PATENT DOCUMENTS

| | | | |
|---|---|---|---|
| 1,228,505 | 6/1917 | Wesson | 42/89 |
| 3,150,459 | 9/1964 | Van Schoick | 42/89 |
| 3,503,150 | 3/1970 | Brunhuber et al. | 42/89 |
| 3,722,125 | 3/1973 | Switzer | 42/89 |

*Primary Examiner*—Charles T. Jordan
*Attorney, Agent, or Firm*—Toren, McGeady and Stanger

[57] ABSTRACT

A device for loading cartridges into the chambers of a revolver has a plate against which the bases of the cartridges are placed, a set of detents arranged around the plate to hold rims on each of the cartridge bases, and a spring for urging the detents and rims against one another to hold the cartridges in place. The set of detents can be rotated so that they release the cartridges, and when this happens, the cartridges are pushed axially into the revolver chambers by the spring. A locking device can hold the cartridges and detents in engagement, and this locking can be released automatically as the cartridges are introduced into the chambers of the revolver.

8 Claims, 3 Drawing Figures

RAPID LOADING DEVICE FOR REVOLVERS

FIELD OF THE INVENTION

The invention relates to a rapid loading device for revolvers, wherein the cartridges can be retained by their rims in a loading drum by means of detent projections and can be inserted into the chambers of the revolver drum by means of spring force.

BACKGROUND OF THE INVENTION

In a known construction of this kind a conical spiral spring is provided for each cartridge and engages the bottom of the latter; when the cartridge is inserted, the spring is retained by the latter in a compressed position. Individual chambers which are separated by appropriate partition walls, are provided for the cartridges. For retaining the cartridges in the inserted position, the partition walls comprise apertures in their region facing the centre; the detent projections retaining the cartridges extend through the apertures and fix the cartridges in the inserted position by way of the rims thereof. This known construction has the disadvantage that it consists of many individual parts and the cartridges are not inserted uniformly in the chambers of the revolver drum in consequence of the separate springs and detent projections. Moreover, it may occur that the rim of one of the cartridges is not engaged completely by the associated detent projection, whereby the rim of the cartridge may slide away from the detent projection upon an even slight shock or the like and thereby the conical spiral spring may eject the cartridge from the loading device, so that secure loading required for such devices is not attainable.

SUMMARY OF THE INVENTION

According to the invention the disadvantages referred to are avoided in a loading device of the kind referred to above in that a central compression spring is provided for inserting the cartridges into the chambers of the revolver drum, one end of the spring being supported on a cartridge plate receiving the rear ends of the cartridges and the other end being supported on a rotary grip member which is rigidly connected to the detent projections. This has the advantage that the force of the compression spring is received commonly by all cartridges, so that in the case that one of the detent projections engages badly behind the rim of the cartridge associated therewith, the remaining cartridges absorb the spring force, whereby an even minor engagement of any cartridge the rim of which is badly gripped by the associated detent projection is already sufficient for preventing this cartridge from dropping out. Moreover, because of the central compression spring, it is possible to construct the rapid loading device in a very slender manner, so that it can be used even in such revolvers in which the drum can be swung away laterally only to a slight extent. Moreover the rapid loading device according to the invention can be used in all commercially available revolvers without alteration of the hand grips.

Advantageously the cartridge plate may be constructed as a disc in which recesses are provided the diameter of which corresponds to that of the rear ends of the cartridges and the depth of which corresponds to the height of the rims of the cartridges. This has the effect that the cartridges are held reliably in their position in the rapid loading device, whereby it becomes superfluous to provide special chambers or the like which prevent the cartridge rims from sliding laterally off the detent projections in the device. Furthermore the cartridge plate may comprise a central bore into and out of which a central body may be pushed which possesses the detent projections. During re-loading the cartridges are thereby inserted deeply into the chambers of the revolver drum by the cartridge plate, since the cartridge plate can be moved as closely as possible to the drum in consequence of the withdrawal of the body possessing the detent projections.

In a particularly simple construction of the body comprising the detent projections, the body may have an approximately star-shaped cross-section with flattened spikes which form the detent projections. In this case the detent projections may be movable in a manner known per se, by twisting the body comprising them, into a position engaging behind the rims of the cartridges, in which position the cartridge plate and the body may be mutually locked together, Thereby a particularly safe engagement behind the cartridge rims by the detent projections is obtained, since the latter are necessarily moved into their engagement position and are locked to the cartridge plate in this position, so that a release of the cartridges is not possible until after the unlocking device has been released. For the purpose of particularly safe locking a radially extending groove may be provided on the side of the cartridge plate facing the rotary grip member and a radially extending pin may be provided in the connecting member between the body comprising the detent projections and the rotary member, the pin being loaded transversely to its axial direction by a spring provided in the connecting member, so as to tend to drop into the groove. Thereby the locking is effected automatically upon rotation relatively to the cartridge plate, of the rotary grip member connected to the detent projections, whereby owing to the spring loading unintentional dropping of the pin out of the groove is as good as excluded, that is to say that the locking can be released only by intentionally lifting the pin out of the groove.

In an advantageous further embodiment of the subject of the invention, the detent projections may be rotatable against the force of a spring relatively to the cartridge plate into their position in which they engage behind the rims of the cartridges. Thereby insertion of the cartridges into the chambers of the revolver drum is effected automatically, since the detent projections are turned away from the cartridge rims by the spring force after release of the locking and the cartridges are thus released for insertion into the chambers of the revolver drum. Thus handling is considerably simplified by such a construction, since it is unnecessary to retain the cartridge plate or the revolver drum for the purpose of inserting the cartridges into the chambers of the revolver drum, in order to render possible a release of the cartridge rims from the clamping effect of the detent projections. In a particularly simple embodiment, the central compression force may serve for exerting the spring force during rotation of the detent projections, and for this purpose the one end of the spring may engage in the cartridge plate and the other end in the rotary grip member rigidly connected to the detent projections. In consequence of the double function thus established of the central compression spring, which is effective thereby as a compression spring as well as a torsion spring, the provision of a further spring may be omitted, so that the slender, space-saving construction can be maintained.

BRIEF DESCRIPTION OF THE DRAWING

One constructional example of the subject of the invention is illustrated in the drawing.

DETAILED DESCRIPTION OF THE EMBODIMENT

Figure 1:
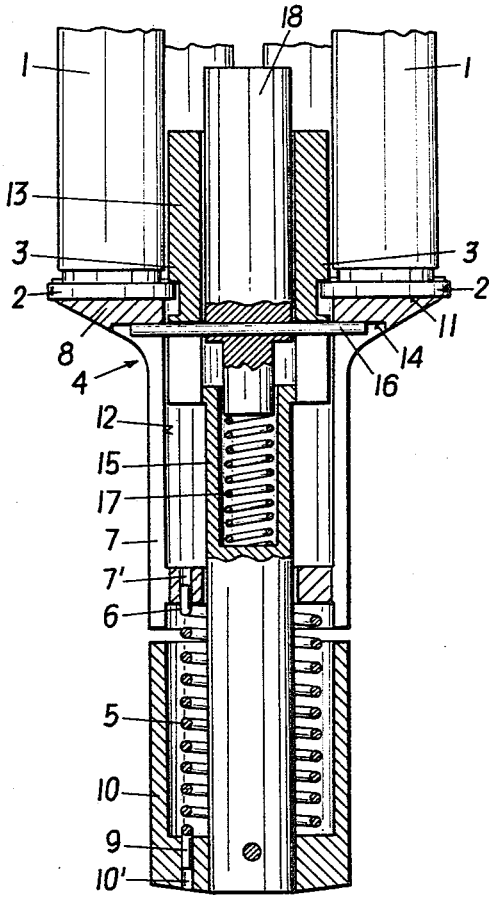
FIG. 1 illustrates a longitudinal section through the rapid loading device.
Figure 3:
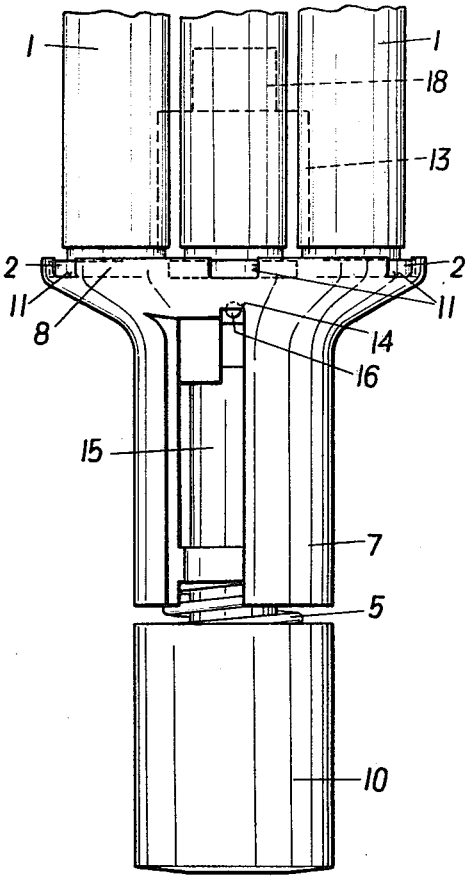
FIG. 3 is a side view.

Reference numeral 1 denotes the cartridges which are retainable in a loading drum 4 by their rims 2 by means of detent projections 3. A central compression spring 5 is provided for inserting the cartridges 1 into the chambers of the revolver drum, and is supported at its one end 6 on a shaft 7 which is formed in one piece with a cartridge plate 8 receiving the rear ends of the cartridges. At its other end 9 the central compression spring 5 is supported on a rotary grip member 10 which is rigidly connected to the detent projections 3. The ends of the spring 5 are cranked, the one end 6 engaging in a bore 7" of the shaft 7 and the other end 9 engaging in a bore 10" of the rotary grip member 10.

Figure 2:
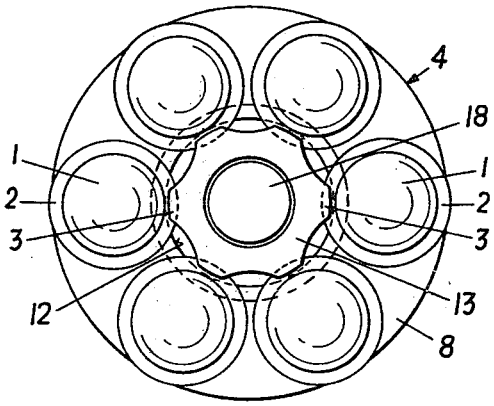
FIG. 2 shows a view from above.

In this case the cartridge plate 8 is in the form of a disc in which recesses 11 are provided, the diameter of which corresponds to that of the rear ends of the cartridges 1 and the depth of which corresponds to the height of the rims 2 of the cartridges. Moreover the cartridge plate 8 possesses a central bore 12 into and out of which a central body 13 can be pushed which comprises the detent projections 3 and which has a star-shaped cross-section with flattened spikes forming the detent projections 3 (see FIG. 2).

For retaining the cartridges 1, the detent projections 3 can be moved into the position in which they engage behind the rims 2 of the cartridges 1 by rotating the body 13. The cartridge plate 8 and the body 13 are mutually lockable in this position. For locking, a radially extending groove 14 is provided on the side of the cartridge plate 8 facing the rotary grip member 10, and a radially extending pin 16 is provided in the connecting member 15 which connects the body 13 comprising the detent projections 3 rigidly to the rotary grip member; the pin 16 is loaded by a spring 17 transversely to its axial direction so as to tend to drop into the groove 14, the spring 17 being provided in the connecting member 15. In this case this loading of the pin 16 occurs by way of a pin 18 which is axially displaceable in the connecting member 15 which contains the pin 16 and on which acts the one end of the spring 17 provided in the connecting member.

For charging cartridges into the rapid loading device described, the cartridges are inserted into an auxiliary loading means not illustrated and withdrawn therefrom by means of the rapid loading device. For this purpose the cartridge plate 8 is placed against the rear ends of the cartridges 1 so that they are located in the recesses 11. Thereafter, the central compression spring 5 is compressed and the body 13 comprising the detent projections 3 is moved along the central bore 12 of the cartridge plate 8 until the detent projections 3 can be moved into the position in which they engage behind the rims 2 of the cartridges by rotating the rotary grip member 10 and thus also the body 13 comprising the detent projections. In this case the rotation of the rotary grip member 10 occurs with opposite twisting of the ends 6, 9 of th central compression spring 5, so that the latter is tensioned like a torsion spring. In this case the rotary movement is performed to such an extend that the radially extending pin 16, under the force of the spring 17, drops into the groove 14, whereby the cartridge plate 8 is locked relatively to the body 13 and thereby reverse-rotation produced by the central compression spring 5 is prevented. The detent projections 3 are then urged by the central compression spring 5 against the rims 2 of the cartridges 1, whereby the rear ends of the latter are held in the recesses 11 of the cartridge plate 8. Unintentional rotation of the cartridge plate 8 relatively to the rotary grip member 10 is prevented by the pin 16 which has dropped into the groove 14.

For inserting the cartridges 1 into the chambers of a revolver drum, the tips of the cartridges are inserted into the chambers and the mutual locking of rotary grip member and cartridge plate is released. The pin 18 which is axially displaceable in the connecting member 15 and which comprises the pin 16 serves for this purpose; it extends through the body 13 comprising the detent projections 3 and its end remote from the rotary grip member 10 projects from this body. When the pin 18 is pressed against the revolver drum, the pin 16 is lifted out of the groove 14 against the force of the spring 17 and thereby the body 13 comprising the detent projections 3 is released for rotation relatively to the cartridge plate 8. Thereby the central compression spring 5 becomes effective as a torsion spring and can now rotate the body 13 back through 30° relatively to the cartridge plate 8 into the starting position, whereupon the detent projections 3 release the rims 2 of the cartridges 1 and the cartridge plate 8 is suddenly moved relative to the body 13 in the direction of the revolver drum by the central compression spring 5, so that the cartridges are propelled into the chambers of the revolver drum.

We claim:

1. A rapid loading device for loading a plurality of cartridges having rims at their rear ends into a revolver, the device comprising:

an annular plate for receiving the rear ends of all the cartridges a central axis extending centrally of, and at right angles to the plane of said plate, a cartridge retaining member angularly movable about said axis to bring retaining means on the member into and out of engagement with the rear rims of all the cartridges simultaneously, and compression spring means acting along said axis to urge the retaining means against the said rims.

2. The device of claim 1, wherein the retaining means are detent projections.

3. The rapid loading device of claim 1, wherein the circular plate has recesses therein, the diameter of which corresponds to that of the rear ends of the cartridges and the depth of which corresponds to the height of the rims of the cartridges.

4. The rapid loading device of claim 1, wherein the cartridge retaining member has an approximately star-shaped cross-section with flattened spikes forming the retaining means.

5. The device of claim 2, wherein the detent projections are movable to and from a position in which they engage behind the rims of the cartridges, and the annular plate and the retaining member are mutually lockable in said position.

6. The device of claim 5 comprising, for locking, a radially extending groove provided on the side of the annular plate which does not receive the cartridges, and a radially extending pin is provided in a connecting member forming part of the retaining member, which pin is loaded transversely of its axial direction in the sense of dropping into the groove by second spring means.

7. The device of claim 6, characterised in that the detent projections are rotatable relative to the circular plate by twisting said compression spring means, into the position in which they engage behind the rims of the cartridges and in which the pin drops into the groove to hold the said spring tensioned.

8. The rapid loading device of claim 7, wherein said compression spring means has one end engaged in the circular plate and its other end engaged in a rotary grip member which is rigidly connected to the detent projections.

* * * * *